US011278054B2

(12) United States Patent
Aznavour

(10) Patent No.: US 11,278,054 B2
(45) Date of Patent: Mar. 22, 2022

(54) WATER-PIPE BOWL AND ROLLER DEVICE

(71) Applicant: HASC Corp., Glendale, CA (US)

(72) Inventor: Hamazasb Aznavour, Glendale, CA (US)

( * ) Notice: Subject to any disclaimer, the term of this patent is extended or adjusted under 35 U.S.C. 154(b) by 358 days.

(21) Appl. No.: 16/580,771

(22) Filed: Sep. 24, 2019

(65) Prior Publication Data

US 2020/0093176 A1 Mar. 26, 2020

Related U.S. Application Data

(60) Provisional application No. 62/735,625, filed on Sep. 24, 2018.

(51) Int. Cl.
*A24F 1/30* (2006.01)

(52) U.S. Cl.
CPC ..... *A24F 1/30* (2013.01)

(58) Field of Classification Search
CPC ..... A24F 1/30
See application file for complete search history.

(56) References Cited

U.S. PATENT DOCUMENTS

| | | | | |
|---|---|---|---|---|
| 8,783,265 | B2 * | 7/2014 | Shakouri Moghadam | A24F 1/30 131/196 |
| 2007/0215164 | A1 | 9/2007 | Mehio | |
| 2011/0186060 | A1 | 8/2011 | Saleh | |
| 2017/0055570 | A1 | 3/2017 | Elhalwani | |
| 2017/0172203 | A1 * | 6/2017 | Gebara | A24F 1/30 |
| 2019/0037914 | A1 * | 2/2019 | Aladin | A24F 9/00 |
| 2019/0261680 | A1 * | 8/2019 | Bavar | A24F 1/30 |

OTHER PUBLICATIONS

Amy Deluxe, "GlasSi Globe Set", https://hookahjunkie.com/products/amy-glassi-globe-set-stone (Year: 2021).*

* cited by examiner

*Primary Examiner* — Cynthia Szewczyk
(74) *Attorney, Agent, or Firm* — Narek Zohrabyan; Phil IP Law Inc.

(57) ABSTRACT

A water-pipe bowl and roller device are disclosed in this invention where the device includes four principal components: a charcoal holder, a roller ball, a water-pipe bowl shell, and an insulated outer sleeve for the water-pipe bowl shell. The roller ball can contain tobacco where the roller ball is orientable to regulate the burn-life of the tobacco by exposing different portions of the bowl to the charcoal. The device allows for a longer smoking session and allows for interchanging between at least two different flavors without re-filling the hookah bowl.

20 Claims, 5 Drawing Sheets

FIG. 1

FIG. 3
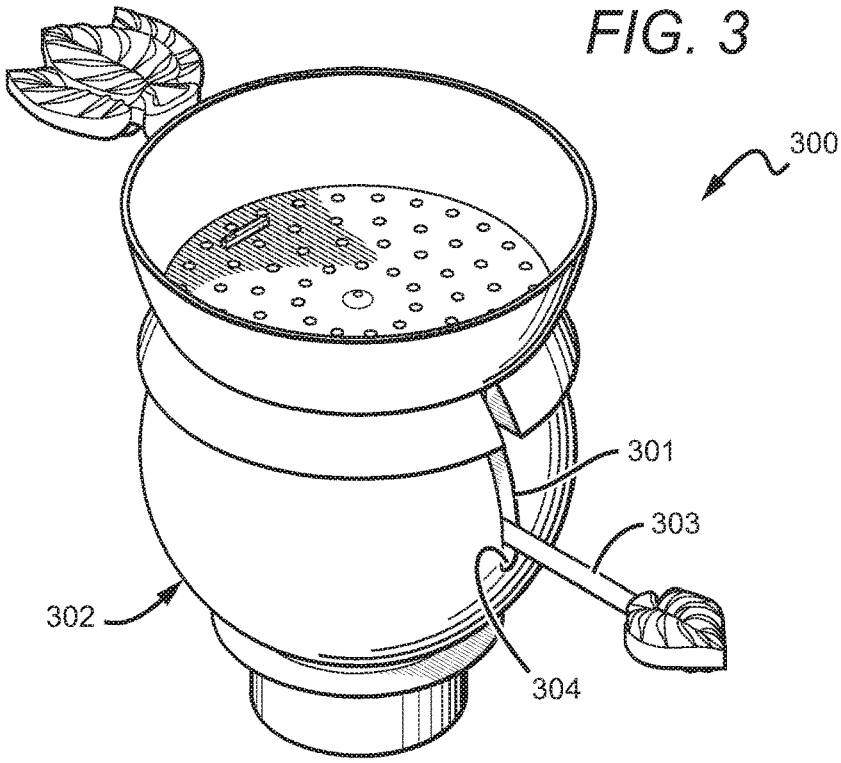
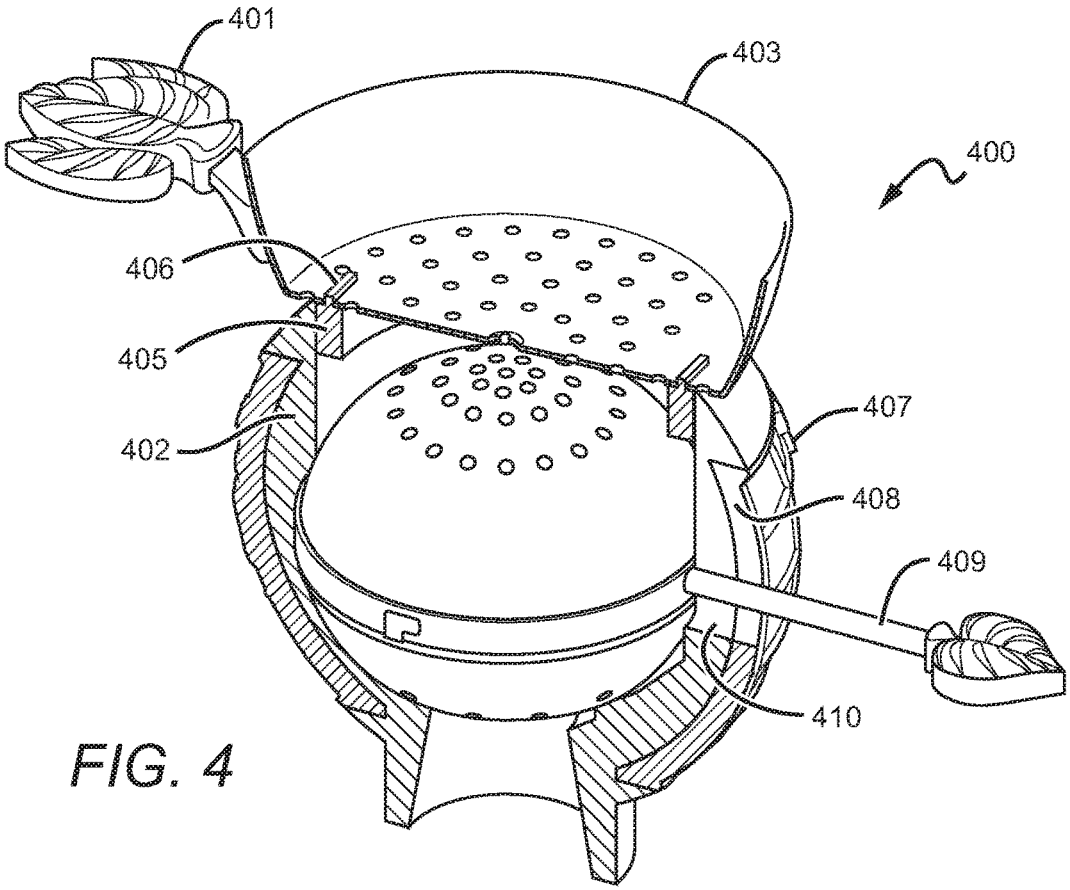
FIG. 4

WATER-PIPE BOWL AND ROLLER DEVICE

CROSS-REFERENCE TO RELATED APPLICATIONS

This patent application claims the benefit of and priority to U.S. Provisional Patent Application No. 62/735,625, filed on Sep. 24, 2018 and entitled "Water-pine Bowl and Roller Device," which is incorporated here by reference in its entirely for all purposes.

FIELD OF THE INVENTION

The present device relates to the field of smoking devices, particularly in the field of water-pipes commonly known as "hooka," "nargilah," "narghille," "shisha," "qalyan" or "galyan," to name few variations.

BACKGROUND

A water-pipe, commonly used in the Middle East over the ages, has become ever so popular in the Occident as well as traveling its way to the Orient. The fundamental function of such a water-pipe is to allow the user to smoke tobacco, possibly even illicit drugs, in a prolonged fashion. Usually, a type of water reservoir known as the vase is attached to an upper section which has a center pipe that is submerged into the water. The upper section has the other end of the pipe which connects with the tobacco holder. The tobacco holder has an opening at the top where tobacco can be packed and covered with some metallic substance such as a thin divider or a section of aluminum foil. The metallic substance is sturdy enough to hold the heated charcoal such that it does not completely or immediately burn the tobacco. The heated charcoal provides the necessary amount of heat to "burn" the tobacco. The metallic substance has various holes made through its cross section which allows air to pass through down to the tobacco and down the pipe.

The heated air and smoke pass though the pipe and down through the water. The reservoir is not completely filled up with water and there is a cavity where the smoke accumulates. Above the waterline, there is another hole which allows the smoke to exit out. A flexible hose is inserted into that exit hole so the smoke can be carried to the user. At the other end of the hose, usually, a mouthpiece is incorporated or installed. Once the user inhales from the mouthpiece, the pressure change from low to high allowing the smoke to be carried from the cavity located in the reservoir up through the hose and into the user's mouth and lungs.

Unlike regular water-pipes, the tobacco holder usually holds a special mix of tobacco and fruit flavored molasses. Because the molasses tends to be moist, the heated charcoal above slowly burns it for a longer draw. This type of water-pipe allows a smoker to get a more recreational experience, by inhaling flavored smoke rather than the tobacco of cigars, cigarettes, pipes, and the like. A connoisseur water-pipe smoker is knowledgeable on how densely to pack the tobacco and how much and where to place the charcoal in the tobacco holder to allow for maximum use and effect.

The mixed tobacco is burned within the tobacco holder at a variable rate based on how far away the charcoal is from the tobacco, how packed the tobacco is, how many charcoals are used, and how densely the charcoal is placed on the top of the bowl. Naturally, the burning charcoal dissipates over time in intensity turning into ash.

Once the tobacco inside the bowl is burnt to completion, the charcoal needs to be removed from the top of the bowl and the bowl itself must be removed, cleaned and re-filled with new tobacco. Once refilled, the bowl is covered with some kind of a metal covering such as aluminum foil and holes are manually punctured in the foil. The process of periodically changing the tobacco takes time, effort and takes away from the experience. Individuals who smoke hookah recreationally want an even draw of smoke for as long as possible with minimal maintenance.

Generally, one hookah bowl can house one flavor and if the smoker wants to change the flavor, they would need to take out the existing hookah bowl, dispense of the tobacco inside and load a new flavor of tobacco. There have been many improvements in the field attempting to improve the hookah smoking experience.

For example, Patent Application Publication No. US2017/0055570 A1, titled Hookah Bowl, published on Mar. 2, 2017, discloses a hookah bowl with compartments where different flavors of tobacco can be packed in each respective compartment. To smoke a different flavor of tobacco, charcoal must be placed directly on top of the desired compartment to smoke that flavor. The issue with this invention is that once the bowl is filled with the different flavors and then covered with the foil, the location of desired tobacco is difficult to find and can be confusing.

Another example is Patent Application Publication No. US2007/0215164 A1, titled Disposable Hookah Bowl, published on Sep. 20, 2007, discloses a disposable bowl with preloaded tobacco. The invention makes the loading and the disposal of the hookah bowl onto the body of the hookah easier and eliminates the packing of tobacco into a hookah bowl. Instead of packing the hookah, one would load the disposable bowl, place hot charcoal on top of the bowl and be able to smoke hookah. When finished, then one would remove the charcoal remove the bowl, dispose of existing bowl, place a new bowl and then continue to smoke. The issue with this invention is that the smoker cannot adjust the flavors inside the bowl and cannot adjust the concentration and location of the tobacco inside the bowl for an optimal smoke.

Another example is Patent Application Publication No. 2011/0186060 A1, titled Hookah Bowl Capsule, published on Aug. 4, 2011, discloses a hookah bowl capsule made of a metallic bowl and a metallic cover with perforations on the cover where the cover and the bowl interlock to make a capsule. The two parts of the hookah bowl capsule are made of first, the bowl where the tobacco is loaded and second the top portion with existing perforations where charcoal is placed. There is an attachment mechanism that hold the bowl and the top portion together securely. The traditional way of loading the tobacco is to load into a usually ceramic bowl and then place an aluminum foil around on top of the bowl and manually make small holes in the foil. The invention replaces the ceramic bowl with a new metallic bowl and the aluminum foil with a metallic covering with the holes already present. The issue with this invention is that one flavor at a time can be enjoyed. There is only space for one flavor or a mixture of flavors, but to smoke one specific flavor and then another flavor is difficult with this invention.

SUMMARY

The present device is directed to water-pipes such that a characteristic tobacco holder known as the bowl is designed to allow for prolonged inhaling of tobacco mix. The water-pipe device includes a outer spherical shell with a cavity. The outer spherical shell is made of some type of a metal such as an aluminum or some type of a metallic alloy. It is also possible to construct the outer spherical shell from tempered glass or some type of a ceramic.

The cavity is designed such that a roller ball can be installed in it. The roller ball holds a certain quantity of tobacco mix. The roller ball is also made of some metallic substance such as aluminum, a metallic alloy, ceramic or as well as tempered glass. The roller ball has two halves referred to as hemispheres. Each hemisphere has a number of holes punched through it to allow air to travel in from the top of the bowl and for smoke to be carried out from the bottom of the bowl. As the two halves come together, they create a generally spherical shape or a roller ball.

The two halves are attached together with use of an L channel locking mechanism. One hemisphere has the L channels located on the edge, specifically in the circumferential interior of the hemisphere. At least two L channels are used for the hemisphere although more channels are also envisioned. The other hemisphere has a cylindrical stud or a raised parabolic perturbation on outer edge surface of the hemisphere. This configuration allows both hemispheres to mate one another and with a twist, lock them together. After locking the roller ball, the contents can be secure and the whole roller ball can be inserted into the bowl.

The roller ball also has a rod riveted or welded unto one side of one of the hemispheres on its x-axis. At the end of the rod there is an insulating cover which allows the user to hold the roller ball without incurring any burns. The insulating cover takes shape of a sphere or some tobacco-oriented item such as a leaf.

The roller ball is usually inserted into the bowl, usually at an angle which provides clearance for the parts to clear the various channels and the openings. One side of the bowl has a channel cutout whereby the long rod slides into as the roller ball. The long rod that is protruding out of the bowl, rests on a retaining wall.

The bowl has an outer sheath made of some insulating substance such as silicone. The silicone sleeve fits snuggly over the bowl in order to provide visual appeal as well as allow the user to handle the bowl without fear of being burned. The outer sheath also has a very thin cut running on in a longitudinal direction. This thin cut line runs partially, possibly stopping midway where the equator would normally be located on the surface of the outer sheath. The thin cut line is terminated by a whole cutout that is at least the diameter of the longer rod. The outer insulation sheath can depict various images or be contoured on the surface. In one embodiment the surface features depict a typical globe with continents, land masses, longitudinal lines and latitudinal lines as raised features. In another embodiment, the insulating sheath depicting the globe, is made of glow in the dark material, completely colorized or each continent is depicted by a different color. The outer sheath is installed by setting it on a flat surface and lowering the bowl—with the roller inserted or without—until the upper lip and lower lip of the outer sheath meet a pair of circular retaining walls. The retaining walls ensure that the outer sheath will not come loose and fall off. However, the outer sheath can be digitally manipulated to allow the user to remove it by pulling it downwards while holding the bowl in midair. This way the user can detach the outer sheath to clean either the bowl and or the sheath.

The bowl has two main openings, one from the top that is the larger opening and another from the bottom that is smaller. The larger opening is a uniform size cylindrical opening. The smaller opening is a semi-conical opening whereby it comes into contact with the water-pipe's upper section.

The charcoal pan is a made of a metallic substance such as aluminum, steel, a metallic alloy, ceramic or as well as tempered glass. The charcoal pan has holes punched at the bottom to allow air to flow through it down into the bowl. The charcoal pan also has a ring attached to it from the underside. This ring is also riveted, welded or otherwise affixed to the pan allowing the pan to sit snuggly into the bowl. Furthermore, the ring also ensures that there is an empty space between the roller ball and the charcoal pan for air to circulate. Lastly, the charcoal pan has a holder riveted, welded or otherwise affixed to allow the user to lift the charcoal pan that is snuggly seated in the bowl. The other end of the holder has it a covering of various shapes and sizes made of an insulating material such as a silicone. In an embodiment, this silicone covering depicts a tobacco leaf.

This invention allows for a prolonged high-quality smoking experience. Because the shape of the bowl is generally spherical, allowing more tobacco to be packed in the cavity and smoked for a longer time by virtue of using the rod welded one of the hemispheres to turn the sphere one hundred and eighty degrees and exposing the other side of the sphere to the charcoal. Further, in the cavity of one hemisphere one flavor of tobacco can be added and in the other cavity of the hemisphere another flavor. When the smoker wants to change the flavors, using the rod and turning it one hundred and eighty degrees, the other flavor can be exposed to the charcoal and smoked.

BRIEF DESCRIPTION OF THE DRAWINGS

Embodiments in accordance with the present device are shown in the drawings and will be described below with reference to the figures, whereby elements having the same effect have been provided with the same reference numerals. The following is shown:

FIG. 3 is a perspective view of the water-pipe bowl and roller device as described.

FIG. 4 is a partial cross sectional and perspective view of the water-pipe bowl and roller device as described.

DETAILED DESCRIPTION

Figure 1:
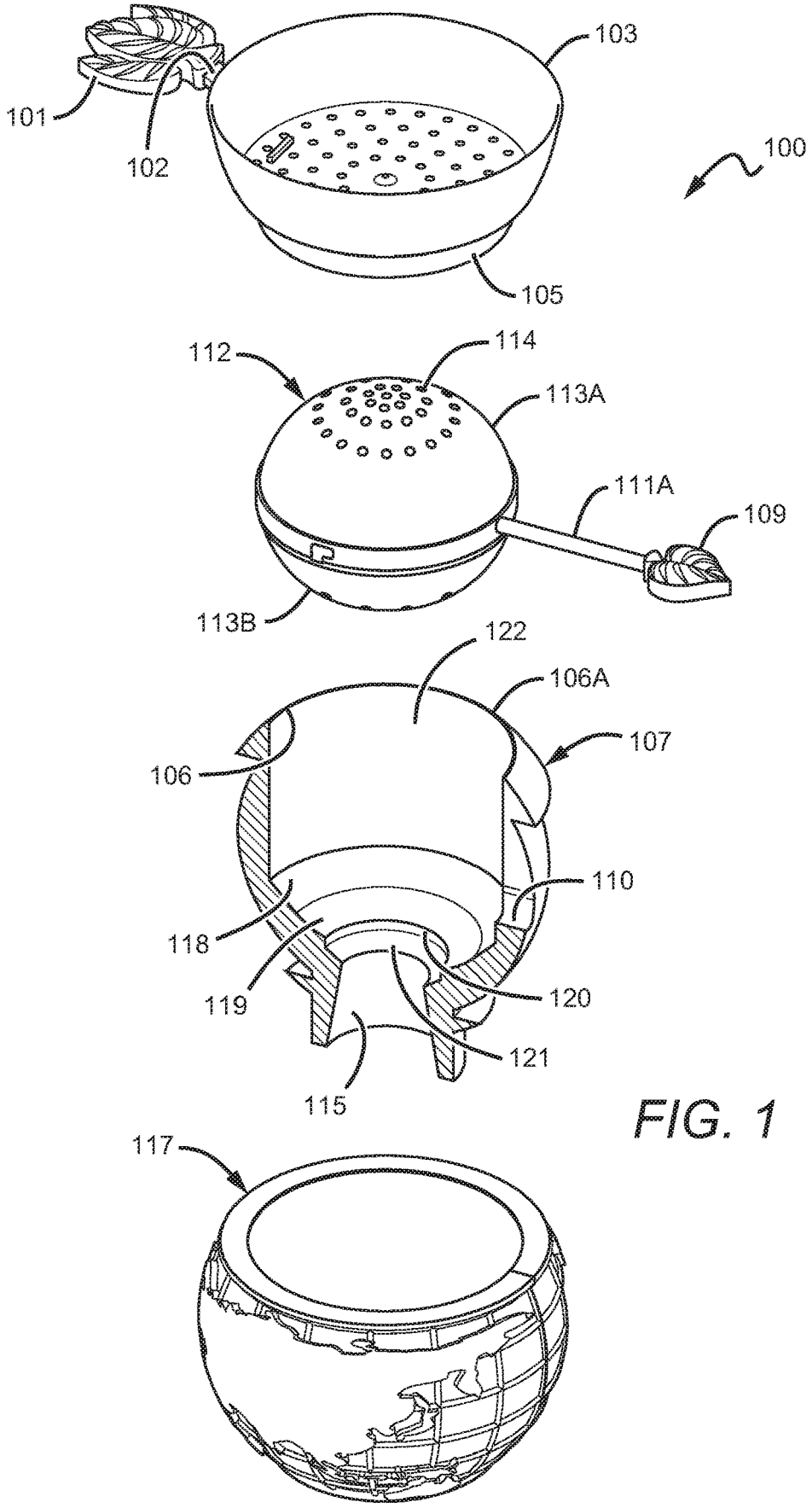
FIG. 1 shows an exploded perspective view of the water-pipe bowl and roller device as described.

An embodiment of the water-pipe bowl and roller device is described herein. FIG. 1 depicts the water-pipe bowl and roller device (100) in an exploded perspective view with certain parts shown in a cross-sectional view. The charcoal pan (103) is a component that sits on top of the water-pipe bowl and roller device (100). The charcoal pan (103) allows the user to put burning charcoals inside it in order to heat up the tobacco underneath it. The charcoal pan (103), in one embodiment, is made of a metallic substance such as aluminum or steal. In another embodiment, the charcoal pan (103) is made of a metallic alloy. In another embodiment, the charcoal pan (103) is made of a ceramic material. Additionally, the charcoal pan (103) can be made of tempered glass. The water-pipe bowl and roller device (100) allows a person to fill a tobacco mix —composed of tobacco and fruit-flavored molasses- and heat it up with charcoal in order to inhale the smoke from a typical water-pipe installation. The water-pipe bowl and roller device (100) is installed on top of a typical water-pipe apparatus.

Figure 2:
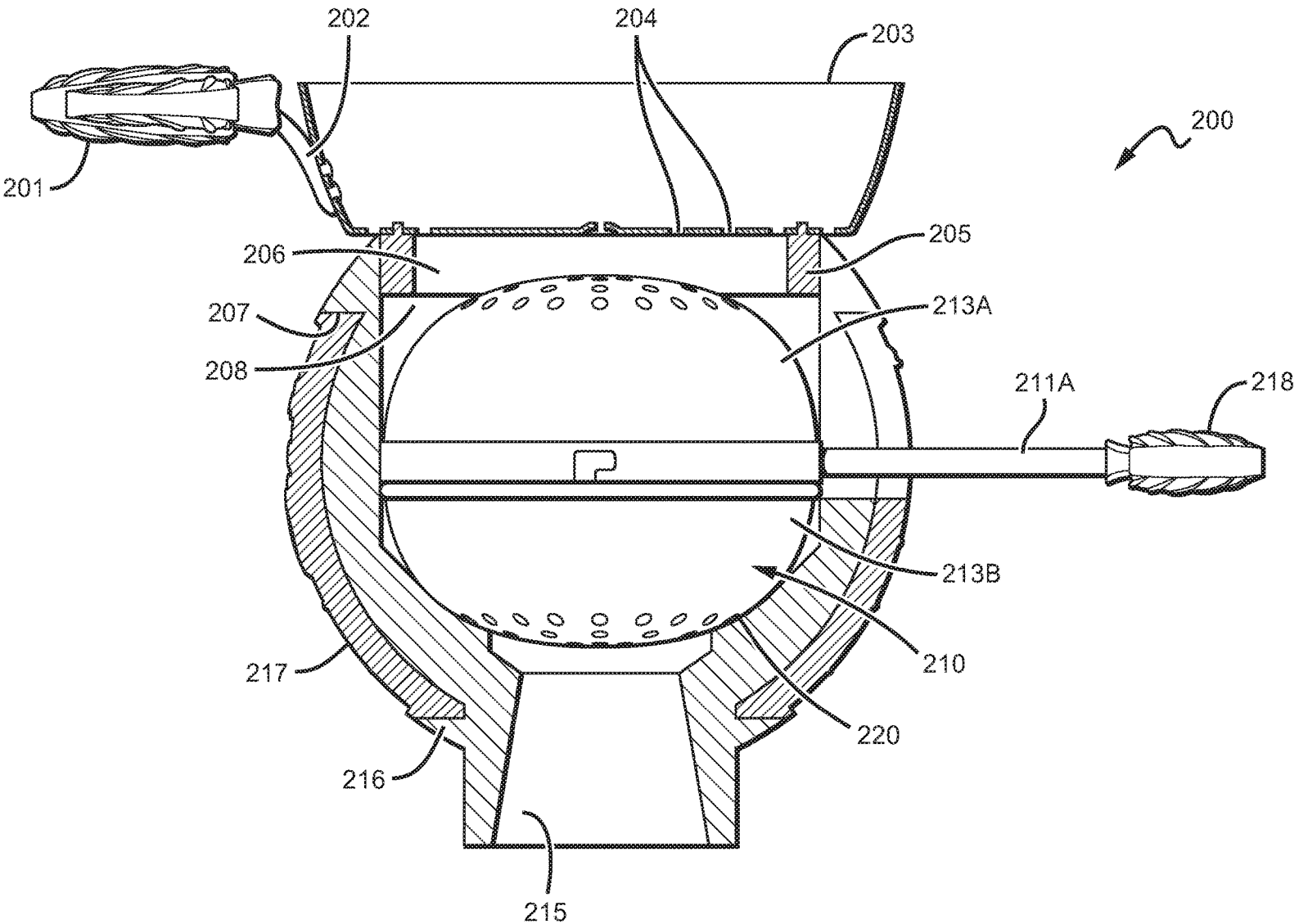
FIG. 2 shows a partial cross-sectional view of the front of the water-pipe bowl and roller device as described.

The charcoal pan (103) has a circular construction as depicted in FIG. 1. The charcoal pan (103) also has a floor made of the same substance that the rest of the charcoal pan (103) is made of and is a unitary piece. The floor of the charcoal pan (103) has holes punched into it, in some predetermined pattern (not referenced in FIG. 1), as shown in FIG. 2 (204).

The charcoal pan (103) has a ring (105) attached to the charcoal pan's (103) underside where the floor is located (not pictured). The ring (105) is attached to the charcoal pan (103) with use of rivets (not pictured), welding, or some other method of affixing. Furthermore, the charcoal pan (103) has a holder (102) attached to the charcoal pan (103) with use of rivet(s) (depicted in FIG. 2) or by some other means. The holder (102) has an insulating sleeve (101). The insulating sleeve (101) can be made of silicone or its functional equivalent. The holder (102) allows the user to lift the charcoal pan (103) from the outer spherical shell (107) while the insulating sleeve (101) provides comfort and safety. Because the charcoal pan (103) can at times get hot, the user is not burned when lifting it due to the protective properties of the insulating sleeve (101). In various embodiments, the holder (102) has a textured insulating sleeve (101) attached to it such as a tobacco leaf. In other embodiments, the holder (102) can have a non-ornamental featured insulating sleeve (101).

The charcoal pan (103) sits on top of the outer spherical shell (107). Specifically, the charcoal pan (103) sits flush with the top opening (106) of the outer spherical shell (107). The ring (105) being snugly fitted into the inside edge (106A) of the outer spherical shell's (107) top opening (106). The outer spherical shell (107) in one embodiment is made of a metallic substance such as aluminum or steel. In another embodiment, the outer spherical shell (107) is made of a metallic alloy. In another embodiment, the outer spherical shell (107) is made of a ceramic material. Additionally, the outer spherical shell (107) can be made of tempered glass.

The outer spherical shell (107) has a cavity inside it to allow the roller ball (112) to be inserted. The roller ball (112) is big enough to allow free movement within the outer spherical shell (107) but snug enough to ensure that it is not too lose to float around due to vibrations or shock forces applied from the environment. The outer spherical shell (107) also has a lower opening (115) which is used to fasten unto a water-pipe's midsection that has an internal pipe (not depicted). The lower opening (115) has a partial conical shape to allow for a snug fitting. The top opening (106) on the other hand is a uniform cylindrical opening. The roller ball (112), in one embodiment, is made of a metallic substance such as aluminum or steel. In another embodiment, the roller ball (112) is made of a metallic alloy. In another embodiment, the roller ball (112) is made of a ceramic material. Additionally, the roller ball (112) can be made of tempered glass.

The roller ball (112) has two hemispheres (113A and 113B). Hemispheres (113A and 113B) have holes (114) dispersed on the radial surface of the structure. The number of holes (114) may vary depending on the particular embodiment. In one embodiment, the holes (114) surround the entire surface of each hemisphere (113A and 113B) up to some minimal distance from the equatorial line (not referenced in FIG. 1). In another embodiment, the holes (114) of the two hemispheres are located mainly at the poles of the roller ball (112). In another embodiment, the holes (114) are located at the poles of the roller ball (112) and by the equator of the roller ball (112) concentrated on the same rotational axis as the holes (114) located at the poles of the roller ball (112). The two hemispheres (113A and 113B) of the roller ball (112) come together and mate to compose the whole of the roller ball (112). In another embodiment, the two hemispheres (113A and 113B) are slightly flattened at the top where the holes (114) are located, to evenly expose the flattened surface area that is in proximity to and facing the charcoal pan (103). They lock together with use of a locking mechanism as shown in FIGS. 5 and 6. The holes (114) allow for air to flow from the top of the roller ball (112) through to the bottom of it where the burned tobacco provides the smoke to exit out of the lower opening (115) of the outer spherical shell (107). The locked hemispheres (113A and 113B) hold within them the tobacco mix.

The roller ball (112) has a long rod (111A) attached to one of the hemispheres (113A or 113B). The long rod (111A) is attached to the hemisphere (113A or 113B) with a rivet (not depicted), through welding, or some other functional means. The long rod (111A) may also be made of the same material as the roller ball (112). The long rod (111A) comes into contact with a retaining wall (110) once the roller ball (112) is inserted into the outer spherical shell (107). The other end of the long rod (111A) is covered by an insulating cover (109). The insulating cover (109) provides safety, security, and grip when operating the water-pipe bowl and roller device (100). The insulating cover (109), in one embodiment, is made of a silicone substance and has an ornamental depiction such as characteristics of a leaf. However, the insulating cover (109) can be fashioned to have ornamental or non-ornamental features. The combination of the insulating sleeve (109) and the long rod (111A) allow the user to hold and insert the roller ball (112) in the bowl's spherical (107) cavity. In one embodiment, the internal cavity of the outer spherical shell (107) is not a perfect sphere, but a sphere with a cylindrical wall (122) that becomes conical and tapered (118) where the roller ball (112) sits against. Then the interior wall (122) further tapers at a more spherical shape (119) to allow the roller ball (112) to snuggly sit in the cavity and provide an airtight seal. The internal cavity continues on by a slight vertical drop (120) and additionally tapers off by a circular angled section (121) to further direct the smoke through the narrow lower opening (115) of the outer spherical shell (107). The gradual tapering of the sphere allows for the reduction of air sneaking in from the sides, diluting the tobacco smoke. Also, the gradual tapering allows for the redirection and concentration of the smoke through a smaller opening into the water filled vase of the hookah.

Furthermore, the combination of the insulating sleeve (109) and the long rod (111A) allow the user to rotate the roller ball (112). By rotating the roller ball (112), the user can smoke for a much longer period and control the burn amount of the tobacco mix. The tobacco contained within the hemispheres (113A and 113B) can be regularly agitated to regulate the burn time such that one side doesn't burn all the way while the other side sits idle for the moisture within the tobacco mix to evaporate. Additionally, because more than one mixture of tobacco can be packed within the roller ball (112) by packing one flavor in one portion of the hemisphere (113A or 113B) and another flavor in the other cavity of the hemisphere (113A or 113B). The user can smoke one flavor at one time by using the combination of the insulating sleeve (109) and the long rod (111A) to turn the roller ball (112) to the other side in order to smoke the other flavor. Furthermore, the user can turn the roller ball (112) partway to use both flavors. This is achieved by turning the roller ball (112) such that the equatorial line (not referenced) is facing up, one end toward the top opening (106) of the outer spherical shell (107) on the other side towards the lower opening (115) of the outer spherical shell (107).

The outer spherical shell (107) is covered by an insulating sheath (117). The insulating sheath (117) may be made of silicone or its functional equivalent. The purpose of the insulating sheath (117) is to provide an ornamental visual effect as well as to protect the user from being burned in case the user touches the outer spherical shell (107) or comes in contact with the water-pipe bowl and roller device (100). The insulating sheath (117), in one embodiment, depicts the land masses and the oceans of the earth along with the longitudinal and latitudinal lines. The insulating sheath (117) however is not limited to this depiction as the visual construction may be ornamental or non-ornamental in nature. The insulating sheath (117) can have coloring hue to it, individual land masses may instead be color coded or the whole insulating sheath (117) can have a fluorescent die incorporated such that it once exposed to the light and then placed in darker surroundings, the insulating sheath (117) will glow in the dark.

FIG. 2 shows a partial cross-sectional view of the water-pipe bowl and rolled device (200) with the outer spherical shell (220) and the roller ball (210) shown as a complete unit on its side view. The outer spherical shell (220) has the charcoal pan (203) seated on top of the outer spherical shell (220). The charcoal pan (203) has the ring (205) attached to the charcoal pan (203) from its underside. The charcoal pan (203) also depicts the floor of the charcoal pan (203) having the holes (204) punched into it. Furthermore, the charcoal pan (203) has the holder (202) riveted to the charcoal pan (203). The holder (202) may be affixed to the charcoal pan (203) by other means such as welding. The holder (202) has on it an insulating sleeve (201) that is indicative of another embodiment of the water-pipe bowl and roller (200) device. The charcoal pan (203) is depicted in FIG. 2 as sitting flush with the outer spherical shell's (220) edge as discussed in the previous paragraphs with relation to FIG. 1. The charcoal pan (203) sits snuggly whereby the ring (205) goes into the outer spherical shell's (220) top opening (208). Directly under the charcoal pan (203) is an open cavity (206) which allows air to circulate. There is thus a varying degree of volume in between the charcoal pan (203) and the roller ball (210).

The roller ball (210) is shown already installed within the outer spherical shell (220). The roller ball (210) has both of its hemispheres (213A and 213B) in a mated and locked position. The roller ball (210) depicts how the long rod (211A) and the partial rod (211B) are positioned within the outer spherical shell (220). Furthermore, the long rod (211A) shows at its termination end, the insulating sleeve (218) indicative of another embodiment of the water-pipe bowl and roller device (200). The roller ball (210) is shown at its set position whereby the partial rod (211B) is held back in place with the retaining wall (209). The roller ball (210) is inserted with the mated hemispheres (213A and 213B) going into the outer spherical shell (220) through its top opening (208). The roller ball (210) is lowered into the cavity of the outer spherical shell (220). The long rod (211A) slides into the longitudinal side of the outer spherical shell (220) where a channel cutout (not referenced) is located on the outer spherical shell (220). This cutout is referenced in FIG. 3 as discussed later. Thus, the roller ball (210) can be freely installed and removed from the outer spherical shell (220) for cleaning and resupplying of the tobacco mix. Furthermore, the roller ball (210), when inserted into the outer spherical shell (220), freely can be rotated to allow for a prolonged and controlled smoking experience.

The outer spherical shell (220) is depicted here with the outer sheath (217) installed on it. The outer sheath (217) is an insulating layer such as silicone or its functional equivalent. The outer sheath (217) is inserted on the outer spherical shell (220) from its underside where the outer spherical shell's (220) lower opening (215) is located. The outer sheath (217) is first placed on a flat surface and the outer spherical shell (220) is lowered unto the outer sheaths (217) top opening. The outer sheath (217) first clears the outer spherical shell's (220) first lip acting as a retaining wall (216) and then is retained against the second lip acting as a retaining wall and second lip (207). Thus, the outer sheath (217) is held in place and between the first lip (216) and the second lip acting as a retaining wall (207). To slide the outer sheath (217) off, one can digitally manipulate and have it clear the first lip (216) in which case it slips right out.

FIG. 3 is a perspective view of the water-pipe bowl and roller device (300) without the outer sheath inserted on it. The outer spherical shell (302) is shown with the longitudinal channel cutout (301) as discussed above. The long rod (303) slides down this channel cutout (301) and comes to rest on its retaining wall (304). The cut out (301) opening, is large enough to allow the long rod (303) to comfortably slide down and sit on the retaining wall (304) and comfortable turn the long rod (303) with minimal friction.

FIG. 4 is a partial cross sectional and perspective view of the water-pipe bowl and roller device (400). The charcoal pan (403) with the insulated holder (401) is shown sitting flush on top of the outer spherical shell (402). The charcoal pan (403) has the ring (405) attached to it through a surface feature (406). Thus, the charcoal pan (403) sits on top of the outer spherical shell (402) with the ring (405) fitting snugly in the inside of the top opening of the outer spherical shell (402). The outer sheath (407) also has a longitudinal cutout (408) which allows the long rod (409) to slide through. The longitudinal cutout (408) is a very thin cut line and is terminated about the equatorial line of the outer sheath (407). The termination point is a small hole (not pictured) with a diameter at least as large as the diameter of the long rod (409). The small hole directly lines up in front of the retaining wall (410) where the long rod (409) comes to rest.

Figure 5A:
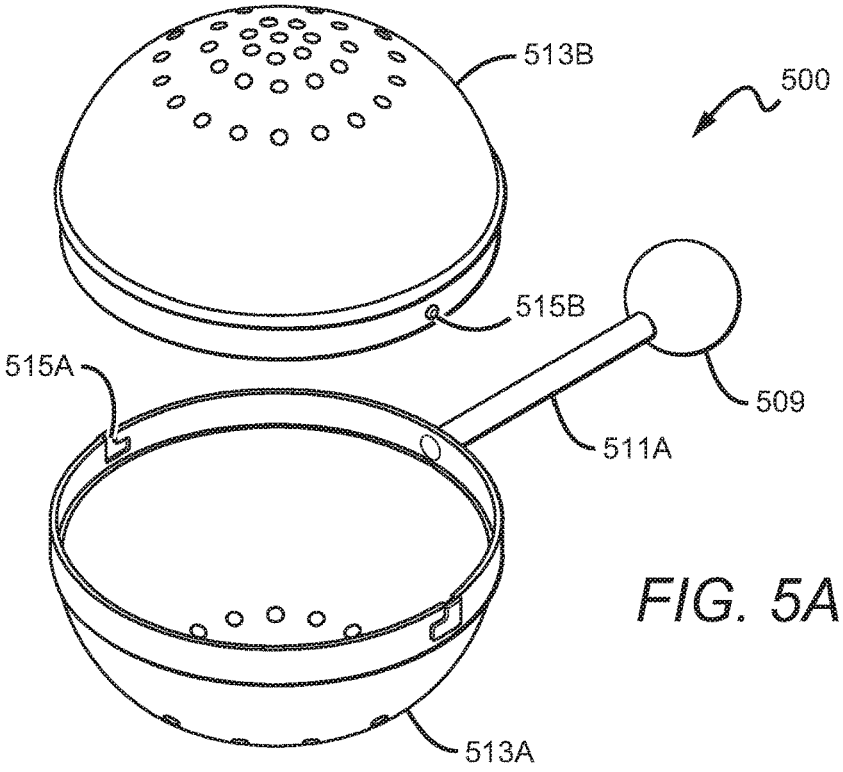
FIG. 5A is an exploded perspective view of the roller ball as described with the water-pipe bowl and roller device with openings located in the center of each hemisphere.
Figure 6:
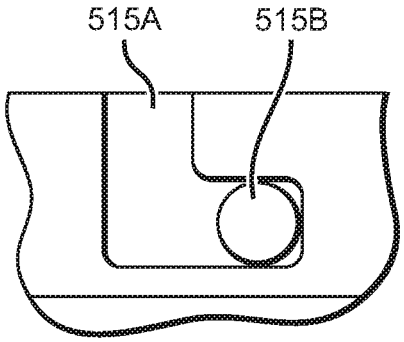
FIG. 6 is a detail view of the L-channel locking system for the roller ball as described with the water-pipe bowl and roller device.

FIG. 5A is an exploded perspective view of the roller ball (500). The roller ball (500) is shown with each hemisphere (513A and 513B) separated from one another. From this depiction, it can be seen that hemisphere (513A) has the long rod (511). The insulating cover (509) is also shown in this embodiment to be a round shape although it can be any shape and have ornamental features. The roller ball (500) hemisphere (513A) is shown to have the L-channel (515A) grooved on the inside part of the equatorial line. In this depiction, there are two L-channels (515A) grooved into hemisphere (513A). On the opposite side, the hemisphere (513B) is depicted which shows the L-channel key (515B). The L-channel key (515B) is either a partial cylindrical protrusion or a radial bump located on the outside part of the equatorial line of the hemisphere (513B). Just like the L-channel (515A), there are two L-channel locks (515B) on the hemisphere (513B). However, it is envisioned that more than a pair of each may be implemented in the roller ball (500). The L-channel (515A) and the L-channel key (515B) allow the hemispheres (513A and 513B) to be mated and locked together.

Figure 5B:
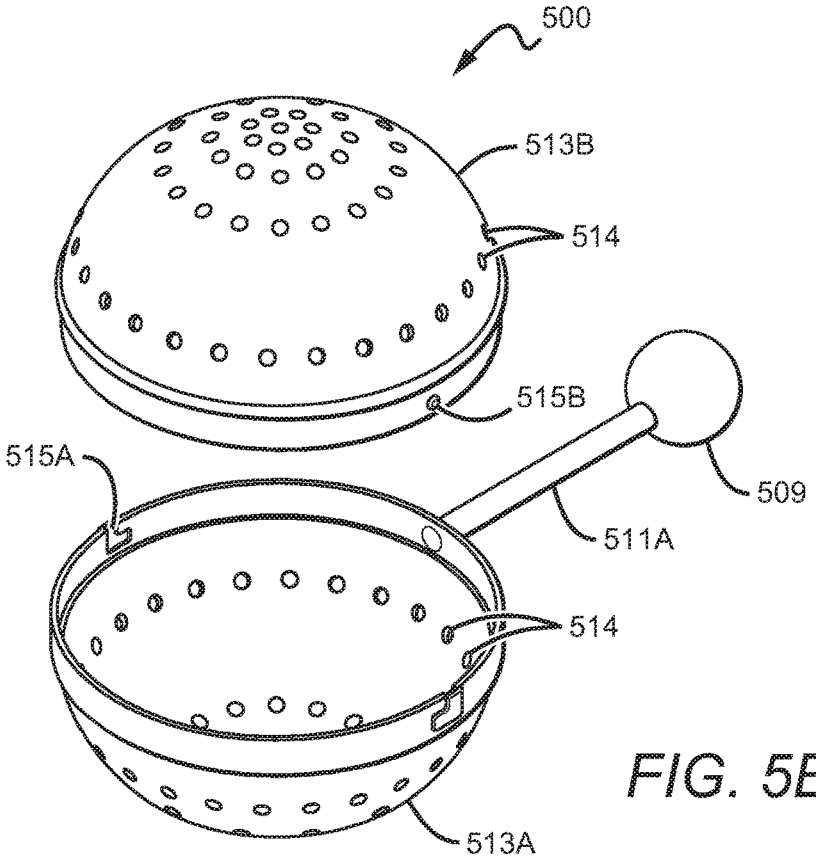
FIG. 5B is an exploded perspective view of the roller ball as described with the water-pipe bowl and roller device with openings located in the center of each hemisphere and at the equatorial line of each hemisphere.

FIG. 5B shows the same roller ball (500) as in FIG. 5A, with additional equatorial perforations (514) located on both hemispheres (513A and 513B). These additional equatorial perforations (514) are used as a means to draw in air and from the top and draw in smoke from the bottom if the roller ball (500) is oriented such that the equatorial line faces the up and down where the top and bottom poles would otherwise be. In essence, the roller ball (500) is being rotated by 90 degrees to the right or to the left. In this modified configuration, the smoker is able to smoke two distinct flavors at the same time in case one hemisphere (513B) is filled with one flavor of tobacco and the other hemisphere (513B) is filled with another flavored tobacco.

FIG. 6 is a detail view of how the L-channel (515A) and the L-channel key (515B) are aligned, inserted, and twisted to lock both hemispheres (513A and 513B) together. Once the L-channel (515A) and the L-channel key (515B) are locked in, the observer cannot see these features from observing the roller ball (500). In addition, because these features are not on the outer surface of the roller ball (500), it can be rotated around the outer spherical shell without further friction. Instead of the L-channel (515A) and the L-channel key (515B) mechanism, the roller ball (500) can be mated in a number of ways such as screwing one hemisphere into the other with use of threads, magnetically mating them together, clasping them together using a male and female mating component or the like.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A water-pipe bowl and roller ball device, comprising:

an outer spherical shell with an opening at the top, an opening at the bottom and a longitudinal opening on the side;

a roller ball constituted by two hemispheres, interlocked together, and inserted into the outer spherical shell;

the roller ball having a long rod installed on one of the hemispheres allowing the unit to be inserted into the outer spherical shell via the longitudinal opening and rotated within the outer spherical shell; and a perforated charcoal pan that is placed directly on top of the outer spherical shell.

2. The water-pipe bowl and roller ball device of claim 1, wherein the bottom opening of the outer spherical shell is tapered to accommodate different pipe diameters.

3. The water-pipe bowl and roller ball device of claim 1, wherein the outer spherical shell is insulated by an outer sheath.

4. The water-pipe bowl and roller ball device of claim 3, wherein the outer sheath is partially or wholly colored and/or is laden with a fluorescent die allowing it to glow in the dark.

5. The water-pipe bowl and roller ball device claim 1, wherein the roller ball constituted by the two hemispheres is slightly flattened at opposite poles that are perpendicular to the long rod.

6. The water-pipe bowl and roller ball device of claim 5, further comprising perforations located at the slightly flattened opposite poles of the roller ball.

7. The water-pipe bowl and roller ball device of claim 6, further comprising perforations located at the same rotational axis as the perforations of the opposite poles, concentrated around the equatorial line of the roller ball.

8. The water-pipe bowl and roller ball device of claim 1, wherein the roller ball is a perfect sphere with perforations located throughout the roller ball.

9. The water-pipe bowl and roller ball device of claim 1, wherein the roller ball is a perfect sphere with perforations located at opposite poles perpendicular to the rod.

10. The water-pipe bowl and roller ball device of claim 9, further comprising perforations located at the same rotational axis as the perforations of the opposite poles, concentrated around the equatorial line of the roller ball.

11. The water-pipe bowl and roller ball device of claim 1, wherein the two hemispheres are interlocked by having an L-channel on one of the hemispheres and an L-channel key on the other corresponding hemisphere.

12. The water-pipe bowl and roller ball device of claim 1, wherein the two hemispheres are interlocked by creating a snug fit between corresponding lips of each hemisphere.

13. The water-pipe bowl and roller ball device of claim 1, wherein the longitudinal opening of the outer spherical shell is sized to allow a comfortable, but snug, fit for the long rod that extends midway through the outer spherical shell.

14. The water-pipe bowl and roller ball device of claim 1, wherein the perforated charcoal pan has an extended arm coated with an insulating material.

15. The water-pipe bowl and roller ball device of claim 1, wherein the perforated charcoal pan has a bottom ring extension allowing a snug fit with the top opening of the outer spherical shell.

16. The water-pipe bowl and roller ball device of claim 1, wherein the two hemispheres are interlocked by screwing one of the hemispheres into the other hemisphere with use of threads.

17. The water-pipe bowl and roller ball device of claim 1, wherein the two hemispheres are interlocked by means of magnetic pieces incorporated unto the equatorial line of the hemispheres.

18. The water-pipe bowl and roller ball device of claim 1, wherein the two hemispheres are interlocked by means of grooves or male protrusions that mate with channels or female orifices.

19. The water-pipe bowl and roller ball device of claim 1, wherein the two hemispheres are interlocked by means of mating one hemisphere unto the other hemisphere.

20. The water-pipe bowl and roller ball device of claim 1, wherein the long rod that extends out from the hemisphere is partially coated by an insulating material.

* * * * *